US011603850B2

(12) United States Patent
Hirota

(10) Patent No.: US 11,603,850 B2
(45) Date of Patent: Mar. 14, 2023

(54) ANALYSIS DEVICE OF VACUUM PUMP, VACUUM PUMP, STORAGE MEDIUM RECORDING ANALYSIS PROGRAM, AND ANALYSIS METHOD

(71) Applicant: SHIMADZU CORPORATION, Kyoto (JP)

(72) Inventor: Kiyonori Hirota, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 17/536,045

(22) Filed: Nov. 28, 2021

(65) Prior Publication Data

US 2022/0186739 A1 Jun. 16, 2022

(30) Foreign Application Priority Data

Dec. 10, 2020 (JP) ..... JP2020-205282

(51) Int. Cl.
*F04D 25/06* (2006.01)
*F04D 27/00* (2006.01)
*F04D 19/04* (2006.01)

(52) U.S. Cl.
CPC ..... *F04D 27/001* (2013.01); *F04D 19/042* (2013.01); *F04D 25/06* (2013.01)

(58) Field of Classification Search
None
See application file for complete search history.

(56) References Cited

U.S. PATENT DOCUMENTS 7,539,549 B1 * 5/2009 Discenzo ..... G05B 23/024 702/183
2018/0066669 A1 3/2018 Tsubokawa
2020/0080564 A1 3/2020 Watanabe

FOREIGN PATENT DOCUMENTS

CN 102812254 A * 12/2012 ..... F04B 49/10
CN 207946701 U * 10/2018
CN 209483643 U * 10/2019 ..... F04D 19/042
CN 112946203 A * 6/2021 ..... G01D 21/02
CN 114106279 A * 3/2022
EP 3660317 A1 * 6/2020 ..... F04D 17/168
JP 2004116328 A * 4/2004
JP 2018040277 A 3/2018
JP 2020041455 A 3/2020

* cited by examiner

*Primary Examiner* — Michael Lebentritt
(74) *Attorney, Agent, or Firm* — Renner, Otto, Boisselle & Sklar, LLP

(57) ABSTRACT

An analysis device of a vacuum pump discharging gas from a vacuum container in which a process for a target object is performed, comprises: an information generation section configured to generate information on a load on the vacuum pump due to an accumulated substance based on an integrated value of a physical quantity regarding rotary drive of a rotor of the vacuum pump in at least part of a period of the process.

12 Claims, 6 Drawing Sheets

ANALYSIS DEVICE OF VACUUM PUMP, VACUUM PUMP, STORAGE MEDIUM RECORDING ANALYSIS PROGRAM, AND ANALYSIS METHOD

BACKGROUND OF THE INVENTION

1. Technical Field

The present invention relates to an analysis device of a vacuum pump, a vacuum pump, a storage medium recording an analysis program, and an analysis method.

2. Background Art

In a vacuum pump, a substance is accumulated on a flow path in which gas discharged from a vacuum container flows, and accordingly, a load might increase and an exhaust capacity might be degraded. In the case of performing a process such as an etching process for semiconductor or liquid crystal in the vacuum container, a product generated by the process flows into the vacuum pump, and therefore, this problem particularly becomes noticeable. It is important to accurately detect an accumulation amount change and make proper countermeasure such as maintenance in advance to prevent exhaust capacity degradation and vacuum pump breakdown. In Patent Literature 1 (JP-A-2018-40277), in a turbo-molecular pump, a product accumulation status is monitored based on a motor current value. In Patent Literature 2 (JP-A-2020-41455), an abnormality due to an increase in a load on a vacuum pump is determined based on the result of comparison between an actual measurement waveform of a motor current value and a reference waveform.

There has been a demand for accurately and efficiently acquiring information on the substance accumulated on the vacuum pump.

SUMMARY OF THE INVENTION

An analysis device of a vacuum pump discharging gas from a vacuum container in which a process for a target object is performed, comprises: an information generation section configured to generate information on a load on the vacuum pump due to an accumulated substance based on an integrated value of a physical quantity regarding rotary drive of a rotor of the vacuum pump in at least part of a period of the process.

According to the present invention, the information on the substance accumulated on the vacuum pump can be accurately and efficiently provided.

DETAILED DESCRIPTION OF THE EXEMPLARY EMBODIMENTS

Hereinafter, a mode for carrying out the present invention will be described with reference to the drawings.

EMBODIMENT

Figure 1:
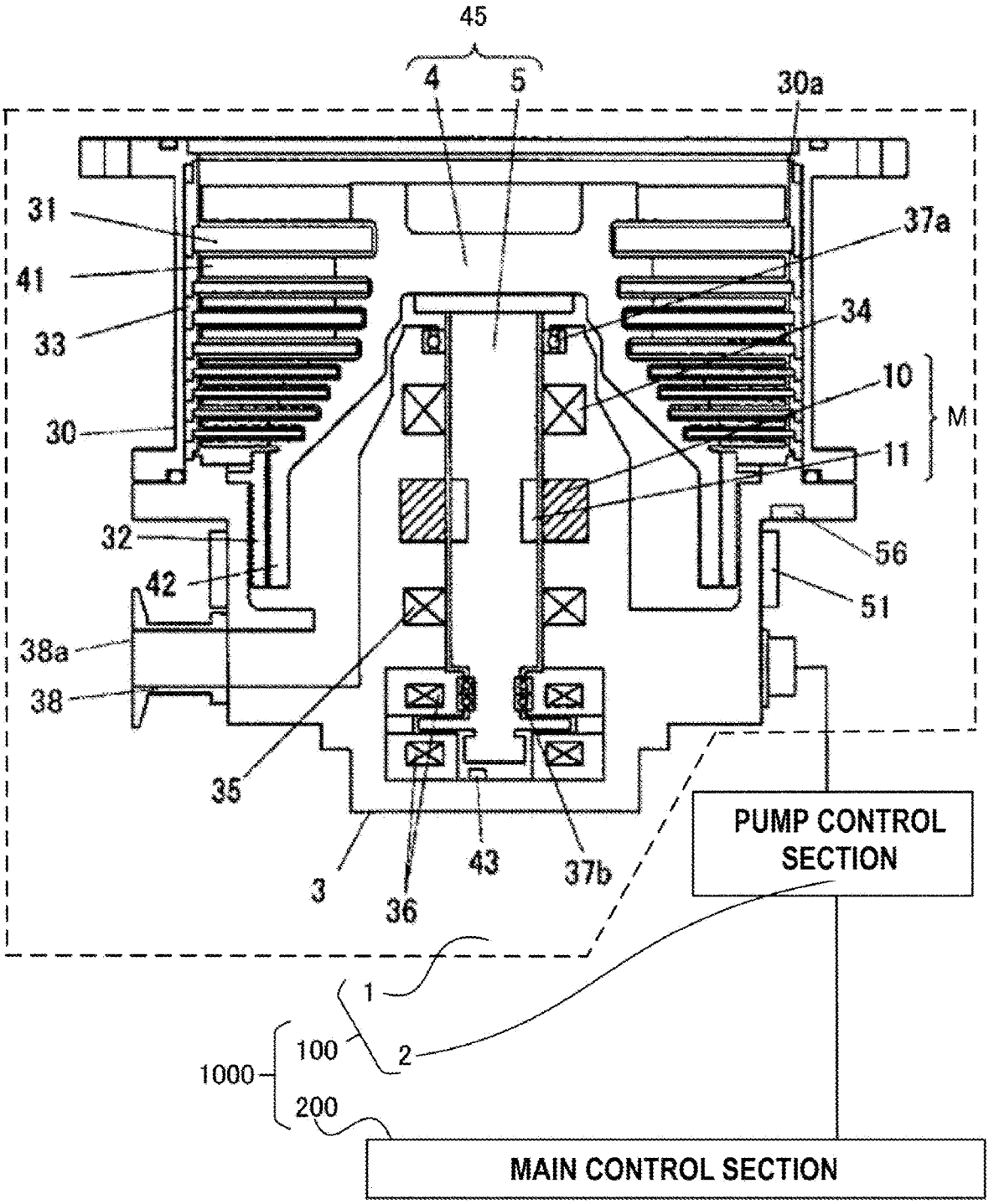
FIG. 1 is a conceptual diagram showing a vacuum pump system of one embodiment.

FIG. 1 is a conceptual diagram showing the configuration of a vacuum pump system of the present embodiment. The vacuum pump system 1000 includes a turbo-molecular pump 100 and a main control section 200. The turbo-molecular pump 100 includes a pump portion 1 configured to perform vacuum pumping and a pump control section 2 configured to drivably control the pump portion 1.

The pump portion 1 has a turbo pump stage including rotor blades 41 and stator blades 31 and a drag pump stage (a screw groove pump stage) including a cylindrical portion 42 and a stator 32. At the screw groove pump stage, a screw groove is formed at the stator 32 or the cylindrical portion 42. The rotor blades 41 as a rotary-side exhaust functional section and the cylindrical portion 42 are formed at a pump rotor 4. The pump rotor 4 is fastened to a shaft 5. The pump rotor 4 and the shaft 5 form a rotary body unit 45.

Multiple stages of the stator blades 31 and the rotor blades 41 are alternately arranged in an axial direction. Each stator blade 31 is placed on a base 3 through a spacer ring 33. When a pump case 30 is fixed to the base 3 with a bolt, the stacked spacer rings 33 are sandwiched between the base 3 and a locking portion 30*a* of the pump case 30, and the stator blades 31 are positioned accordingly. An exhaust pipe 38 formed with an exhaust port 38*a* is provided at the base 3. A not-shown back pump is connected to the exhaust pipe 38 so that gas can be discharged.

The turbo-molecular pump 100 shown in FIG. 1 is a magnetic levitation turbo-molecular pump, and the rotary body unit 45 is contactlessly supported by magnetic bearings 34, 35, 36 provided at the base 3. The magnetic bearings 34, 35, 36 include bearing electromagnets and displacement sensors configured to detect, e.g., a levitation position of the rotor shaft 5.

The rotary body unit 45 is rotatably driven by a motor M. The motor M includes a motor stator 10 provided on a base 3 side and a motor rotor 11 provided on a rotor shaft 5 side. When the magnetic bearings 34, 35, 36 are not in operation, the rotary body unit 45 is supported by emergency mechanical bearings 37*a*, 37*b*. The rotation number of the rotary body unit 45 is detected by a rotary body sensor 43 arranged at the base 3. A detection signal detected by the rotary body sensor 43 is input to the pump control section 2. At this point, the detection signal is analog/digital-converted (A/D-converted) by the rotary body sensor 43 or the pump control section 2, as necessary.

A heater 51 and a not-shown coolant water pipe for controlling the temperature of the base 3 are provided at the outer periphery of the base 3. The temperature of the base 3 is detected by a temperature sensor 56. Based on the temperature detected by the temperature sensor 56, the temperature of the base 3 is controlled using the heater 51 and coolant water by the pump control section 2. Detailed description of temperature control will be omitted.

Note that arrangement of the heater 51, the exhaust pipe 38, the temperature sensor 56 and the like is not specifically limited to that of the form of FIG. 1.

Figure 2:
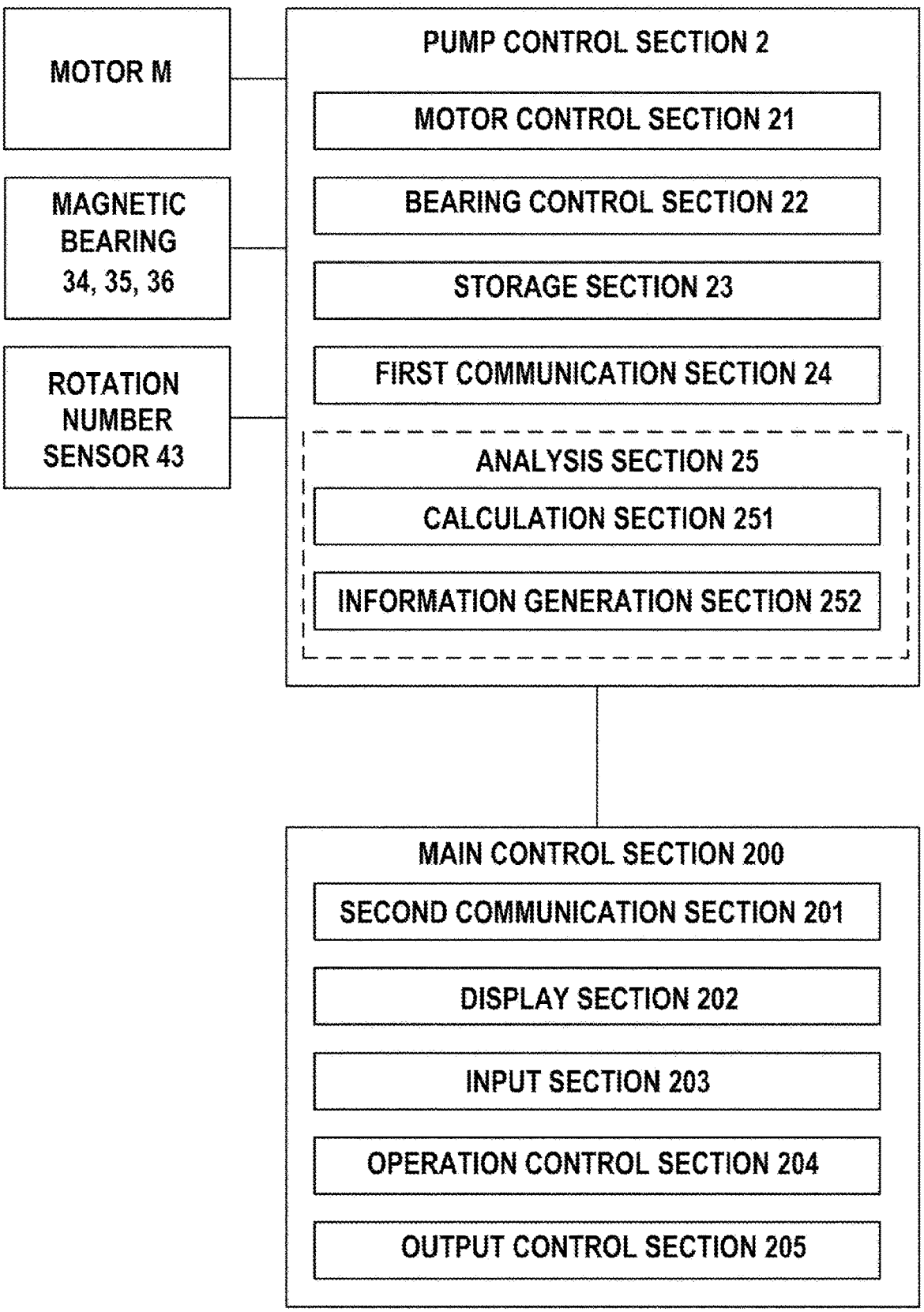
FIG. 2 is a conceptual diagram showing the configurations of a pump control section and a main control section.

FIG. 2 is a conceptual diagram showing the configurations of the pump control section 2 and the main control section 200. The pump control section 2 includes a motor control section 21, a bearing control section 22, a storage section 23, a first communication section 24, and an analysis section 25. The motor control section 21, the bearing control section 22, and the analysis section 25 are physically formed by processing devices. The analysis section 25 includes a calculation section 251 and an information generation section 252. The main control section 200 includes a second communication section 201, a display section 202, an input section 203, an operation control section 204, and an output control section 205. The operation control section 204 and the output control section 205 are physically formed by processing devices.

The pump control section 2 is electrically connected to the motor M and the magnetic bearings 34, 35, 36 to control the motor M and the magnetic bearings 34, 35, 36. Moreover, the pump control section 2 functions as an analysis device of the vacuum pump.

The motor control section 21 estimates the rotation number of the rotor shaft 5 based on the detection signal detected by the rotation number sensor 43 to control the motor M to a predetermined target rotation number based on the estimated rotation number. A load on the pump rotor 4 increases as a gas flow rate increases, and therefore, the rotation number of the motor M decreases. The motor control section 21 controls a motor current such that a difference between the rotation number detected by the rotation number sensor 43 and the predetermined target rotation number becomes zero, and in this manner, the predetermined target rotation number (a rated rotation number) is maintained.

The bearing control section 22 controls operation of the bearing electromagnets based on detection signals detected by the displacement sensors arranged at the magnetic bearings 34, 35, 36.

The storage section 23 includes a storage medium, and stores data for executing processing by the pump control section 2. The storage section 23 can be configured to store an analysis program for performing analysis processing of the later-described information generation section 252. In this case, the analysis processing is performed in such a manner that the analysis program is read into a memory of the pump control section 2 and a CPU of a processing device executes the analysis program. As long as each type of processing of the present embodiment is executable, a physical configuration of the processing device is not specifically limited.

The first communication section 24 includes a communication device communicable with the second communication section 201 of the main control section 200. The first communication section 24 receives, from the main control section 200, information necessary for control of each portion of the pump portion 1 and a signal for instructing the start or end of operation, for example. The first communication section 24 transmits, to the second communication section 201, information such as information indicating the state of each portion of the pump portion 1 and later-described accumulated substance information generated by the information generation section 252.

The analysis section 25 analyzes an exhaust load on the turbo-molecular pump 100 to generate information indicating an analysis result. When an inflow substance from a vacuum container connected to the turbo-molecular pump 100 so that gas can be discharged is accumulated on a flow path of the pump portion 1 in which gas discharged from the vacuum container flows, the load increases. The analysis section 25 analyzes such an exhaust load due to the accumulated substance. The analysis section 25 generates information on the load on the turbo-molecular pump 100 due to the accumulated substance. Such information will be referred to as the accumulated substance information.

The analysis section 25 generates the accumulated substance information when a process for a target object is performed in the vacuum container. This process is not specifically limited as long as there is a probability that a substance which might be accumulated on the flow path of the pump portion 1 is generated in the process. In a semiconductor or liquid crystal manufacturing process, specifically an etching process, a product is accumulated on the flow path of the pump portion 1, and causes the exhaust load. Thus, for preventing exhaust capacity degradation and vacuum pump breakdown by proper countermeasure made in advance, such as maintenance, the analysis section 25 preferably generates the accumulated substance information when such a process is performed.

The calculation section 251 of the analysis section 25 calculates an integrated value of a physical quantity regarding rotary drive of the rotary body unit 45 in the process for the target object. Hereinafter, mere description of the integrated value will indicate the integrated value of the physical quantity. In the present embodiment, the motor current of the motor M will be described as an example of the physical quantity regarding the rotary drive.

The calculation section 251 calculates the integrated value for each process. The calculation section 251 preferably calculates the integrated value for each target object or for each particular process performed for the target object. The particular process can be a process in which a product is easily generated by, e.g., the etching process. The calculation section 251 preferably calculates the integrated value for each process in a case where the same process is repeated for each target object as in a mass-produced product manufacturing process.

The calculation section 251 acquires motor current data indicating the motor current for each process. The motor current data indicates a motor current value at each point of time. The calculation section 251 extracts, with reference to the motor current data, the motor current data corresponding to each process.

Figure 3:
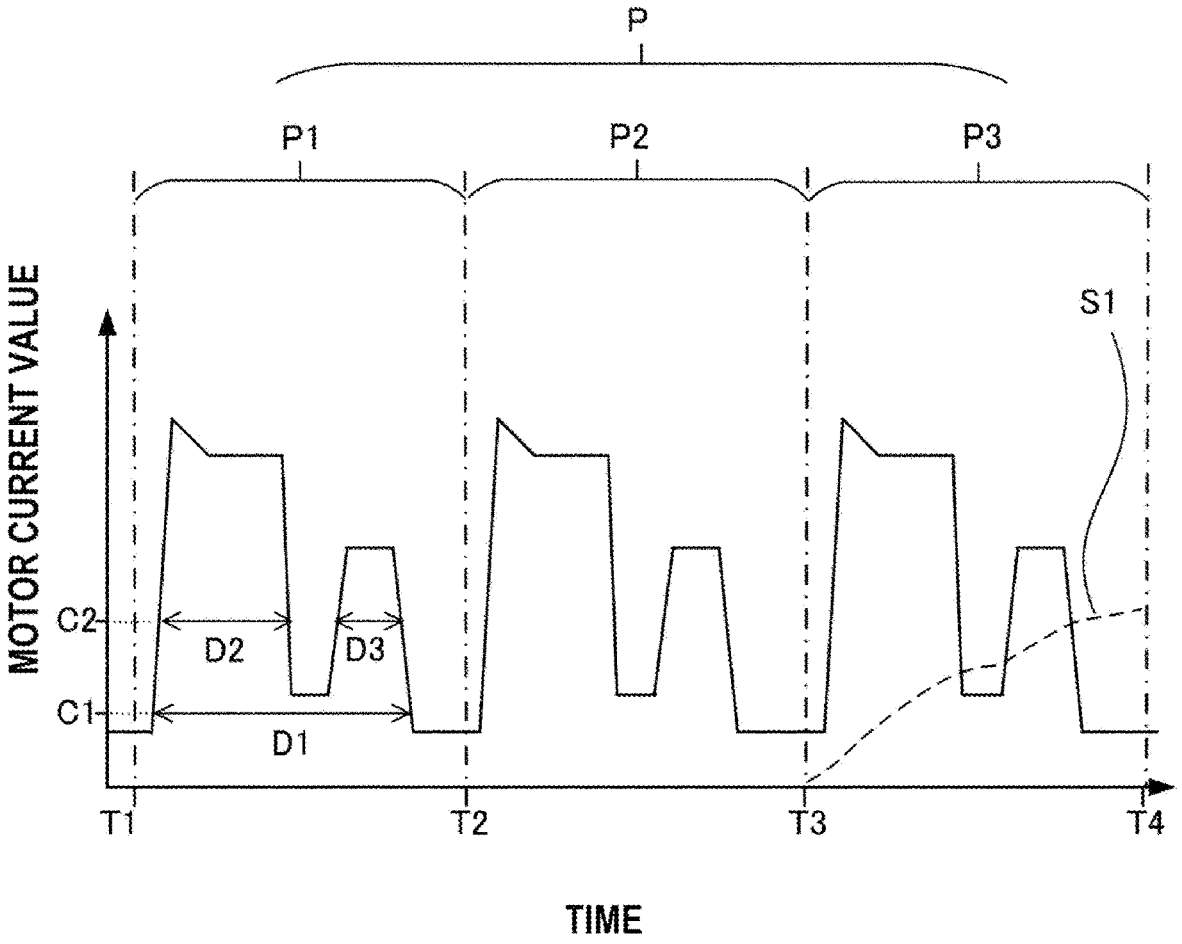
FIG. 3 is a conceptual diagram for describing a change in a motor current.

FIG. 3 is a conceptual diagram for describing the method for calculating the integrated value in the present embodiment. A graph of FIG. 3 shows the current value (the vertical axis) of the motor M at each point of time (the horizontal axis) in a case where a particular process P is performed for target objects in the vacuum container from which gas is discharged by the turbo-molecular pump 100. In a period from T1 to T2, a period from T2 to T3, and a period from T3 to T4, first to third element processes P1, P2, P3 are performed for different target objects. The first to third element processes P1 to P3 are performed such that the process for the different target objects is performed in the particular process P. As described above, in the present embodiment, the calculation section 251 calculates the integrated value in each process in a case where the particular process is performed for each target object. The calculation section 251 can calculate the integrated value for the element process every time the process is performed for the target object or every time the particular process is performed. The motor control section 21 performs the control of maintaining the rated rotation number, and therefore, when gas necessary for the process is injected into the vacuum container and the exhaust load increases accordingly, the motor current value increases to compensate for such an increase.

Note that the graph of FIG. 3 is an example for the sake of simple description, and the analysis method according to the present embodiment is not limited to these contents of the graph.

The calculation section 251 extracts the motor current data targeted for integration for each particular process P based on a time point at which the motor current value exceeds or falls below a preset threshold. Alternatively, the calculation section 251 extracts the motor current data targeted for integration for each process P based on, e.g., the value of the rising or falling gradient of the motor current value. For example, the calculation section 251 can extract, as a period targeted for integration of the motor current value of the element process P1, a period D1 in the figure from time points at which the motor current value exceeds and falls below a motor current threshold C1. Alternatively, the calculation section 251 can extract, as the period targeted for integration of the motor current value of the element process P1, periods D2, D3 based on time points at which the motor current value exceeds and falls below a motor current threshold C2. The same also applies to other element processes P2, P3. As described above, the period targeted for integration by the calculation section 251 is not limited to the entire period of each element process Pi (i is any of 1, 2, and 3 in the above-described example), and may be at least part of the period in which each element process Pi is performed and may be a continuous or discontinuous period while the single process Pi is being performed.

Note that the calculation section 251 may acquire the start or end time of each element process Pi from, e.g., the main control section 200 to extract the motor current data targeted for integration of each element process Pi based on the acquired time.

The calculation section 251 stores the integrated value, which is obtained by integration of the motor current value in the period targeted for integration, for each element process Pi in, e.g., the storage section 23. A dashed line S1 schematically shows, as a reference, the integrated value for the process P3 in a case where the period from T3 to T4 is taken as the period targeted for integration and the motor current value is integrated from T3 to T4. As the integrated value, a value from which, e.g., contribution of noise or a background has been removed as necessary can be used. The calculation section 251 can store the integrated value in association with, e.g., the number of the element process Pi or the date and time of execution of the element process Pi. After the accumulated substance has been removed by, e.g., maintenance, the number of the element process Pi can be reset and counted from one.

Referring back to FIG. 2, the information generation section 252 of the analysis section 25 generates the accumulated substance information based on the integrated value calculated by the calculation section 251. The information generation section 252 uses the integrated value as the indication of the amount of substance accumulated on a flow path of the turbo-molecular pump 100 or the indication of the exhaust load, thereby generating the accumulated substance information. In this sense, the integrated value will be referred to as an accumulated substance index, as necessary. The contents of the accumulated substance information are not specifically limited as long as the accumulated substance information indicates, e.g., the amount of substance accumulated on the flow path of the pump portion 1, the degree of load due to the accumulated substance, or the necessity of maintenance. Hereinafter, an example where the information generation section 252 determines whether or not the integrated value exceeds a preset threshold and generates the accumulated substance information including the necessity of maintenance based on such determination will be described. Such a threshold will be referred to as a maintenance threshold. The maintenance threshold is stored in, e.g., the storage section 23 in advance.

The information generation section 252 generates the accumulated substance information indicating that maintenance is necessary in a case where the integrated value calculated by the calculation section 251 exceeds the maintenance threshold, and generates the accumulated substance information indicating that maintenance is not necessary in a case where the integrated value is equal to or smaller than the maintenance threshold. As described above, the information generation section 252 functions as a determination section configured to determine whether or not countermeasure for preventing an abnormality due to a load increase caused by the accumulated substance is necessary. In other words, the information generation section 252 functions as a sign detection section configured to detect the sign of the abnormality due to the accumulated substance.

Note that in a case where the above-described determination is performed utilizing the maintenance threshold, the form of such determination is not specifically limited as long as determination is performed under a condition based on the maintenance threshold, and is not necessarily "exceeds the maintenance threshold or not," but may be "equal to or greater than the maintenance threshold or not," for example. Moreover, the determination is not limited to the necessity of maintenance, and a threshold can be set as necessary to prevent an optional degree of load.

The information generation section 252 transmits the accumulated substance information to the main control section 200 via the first communication section 24. The method and form for expressing the accumulated substance information are not specifically limited. For example, the accumulated substance information may indicate the necessity of the countermeasure such as maintenance by a binary value, or may indicate the amount of accumulated substance, the degree of load due to the accumulated substance, or the necessity of maintenance in a stepwise manner by, e.g., a numerical value or a symbol. Alternatively, the accumulated substance information may indicate, e.g., the necessity of maintenance by a character or a text.

The main control section 200 functions as an interface with a user (hereinafter merely referred to as a "user") of the vacuum pump system 1000.

The second communication section 201 of the main control section 200 includes a communication device communicable with the first communication section 24 of the pump control section 2. The second communication section 201 transmits, to the pump control section 2, information necessary for control of each portion of the pump portion 1 and a signal for instructing the start or end of operation, for example. The second communication section 201 receives, from the first communication section 24, information such as information indicating the state of each portion of the pump portion 1 and the accumulated substance information generated by the information generation section 252.

The display section 202 of the main control section 200 includes a display device such as a liquid crystal monitor. The display section 202 displays, e.g., the accumulated substance information on the display device under the control of the output control section 205.

The input section 203 of the main control section 200 includes an input device such as a mouse, a keyboard, various buttons, or a touch panel. The input section 203 receives, from the user, information necessary for the processing of the main control section 200 or the pump control section 2.

The operation control section 204 of the main control section 200 transmits a signal to the pump control section 2 to control operation of the turbo-molecular pump 100. For example, the operation control section 204 sets a condition regarding operation of the turbo-molecular pump 100 based on, e.g., input via the input section 203, and transmits the signal to the pump control section 2 such that the turbo-molecular pump 100 is operated to satisfy such a condition.

Note that as long as the above-described processing according to the present embodiment can be performed, physical configurations of the motor control section 21, the bearing control section 22, and the analysis section 25 of the pump control section 2 and physical configurations of the operation control section 204 and the output control section 205 of the main control section 200 are not specifically limited.

The output control section 205 of the main control section 200 displays the accumulated substance information on the display section 202 or transmits the accumulated substance information via the second communication section 201, thereby outputting the accumulated substance information. Generation of the accumulated substance information by the information generation section 252 and output of the accumulated substance information by the output control section 205 may be performed at a preset point of time or at a preset time interval, or may be performed when input from the user is made via the input section 203. The form of the displayed accumulated substance information is not specifically limited, and the contents of the accumulated substance information can be provided in the form of, e.g., a character, a text, a symbol, or a figure. A warning may be displayed on a display screen by means of, e.g., a pop-up message.

Figure 4:
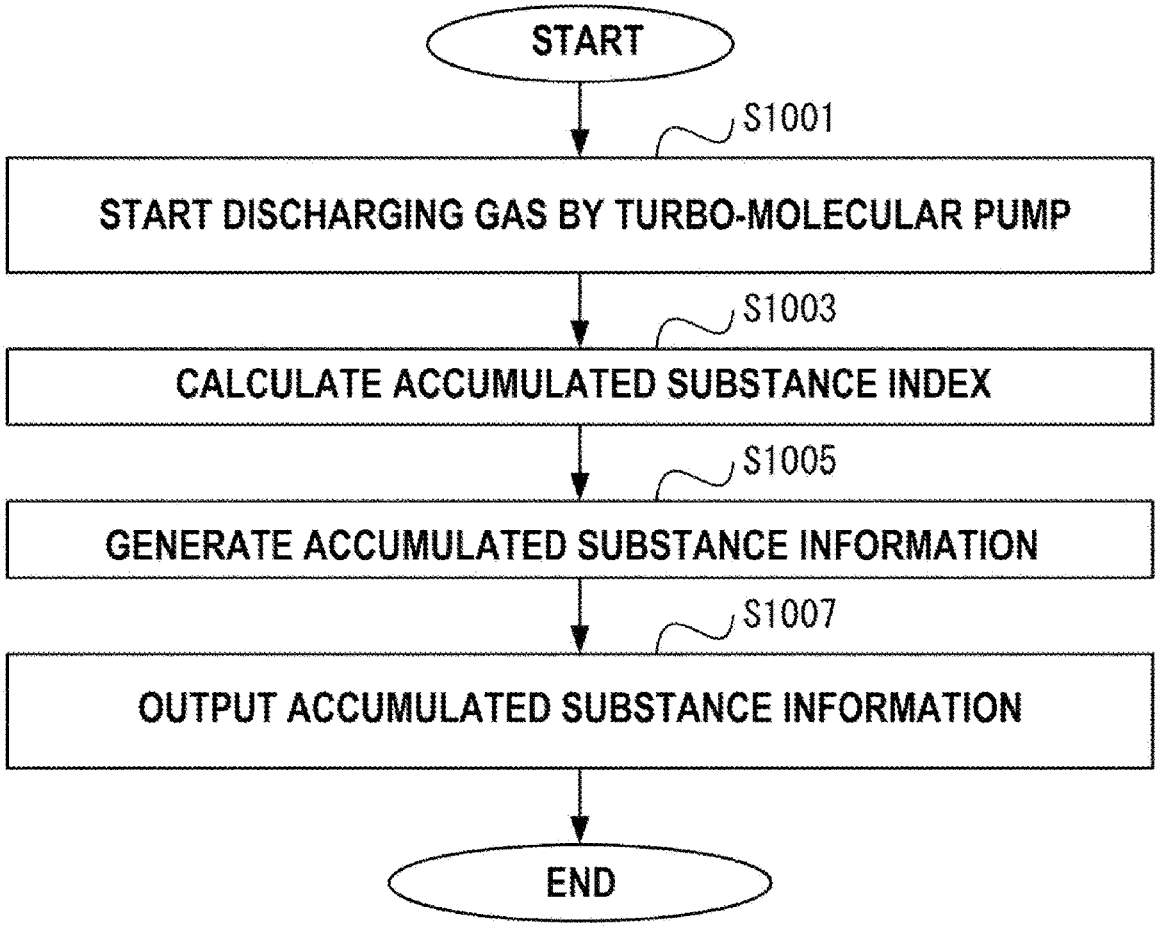
FIG. 4 is a flowchart showing the flow of an analysis method of a vacuum pump according to one embodiment.

FIG. 4 is a flowchart showing the flow of the analysis method of the vacuum pump according to the present embodiment. This analysis method is performed by the processing device arranged at the vacuum pump system, and accurately and efficiently provides the information on the substance accumulated on the vacuum pump. At a step S1001, the operation control section 204 transmits the signal to the pump control section 2 to start gas discharge by the turbo-molecular pump 100. When the step S1001 ends, a step S1003 starts. At the step S1003, the calculation section 251 calculates the integrated value as the accumulated substance index from the motor current data. When the step S1003 ends, a step S1005 starts.

At the step S1005, the information generation section 252 generates the accumulated substance information based on the accumulated substance index. When the step S1005 ends, a step S1007 starts. At the step S1007, the output control section 205 outputs the accumulated substance information. When the step S1007 ends, the processing ends.

Note that the calculation section 251 may calculate the accumulated substance index in real time while the process is being performed, or may calculate the accumulated substance index from the collected motor current data by batch processing.

According to the above-described embodiment, the following features and advantageous effects are obtained.

(1) The analysis device (the pump control section 2) of the vacuum pump and the vacuum pump system 1000 according to the present embodiment include the information generation section 252 configured to generate the accumulated substance information based on the integrated value of the motor current of the motor M rotatably driving the pump rotor 4 in at least part (D1, D2, D3 and the like) of the element process Pi for the target object. With this configuration, the information on the substance accumulated on the turbo-molecular pump 100 can be accurately and efficiently provided.

(2) The analysis device (the pump control section 2) of the vacuum pump according to the present embodiment calculates the above-described integrated value for each target object or every time the particular process P (a particular process) for the target object is performed. With this configuration, a change in the physical quantity regarding the rotary drive of the pump rotor 4 can be more accurately detected.

The following variations are also within the scope of the present invention, and can be combined with the above-described embodiment. In the following variations, the same reference numerals are used to represent, e.g., elements having structures and functions similar to those of the above-described embodiment, and description thereof will be omitted as necessary.

(First Variation)

In the above-described embodiment, the information generation section 252 may take, instead of the integrated value, a value obtained by division of the integrated value by a gas injection time as the accumulated substance index to generate the accumulated substance information. The gas injection time described herein is a period in which gas is, during the period targeted for integration, injected into the vacuum container from which gas is discharged by the turbo-molecular pump 100. During the gas injection time, the exhaust load increases. The gas injection time is equivalent to a period in which the motor current increases, and is equivalent to the sum of D2 and D3 in the element process P1 of FIG. 3. For example, the motor current value is integrated from T1 to T2, and a value obtained by division of the obtained integrated value by the gas injection time D2+D3 can be taken as the accumulated substance index. In a period other than the gas injection time, the motor current value tends to decrease. Thus, the integrated value is divided by the gas injection time so that the accumulated substance index can be more accurately calculated even with a variation in the gas injection time among the element processes Pi. A value obtained after, e.g., noise or a background has been removed from the integrated value may be divided by the gas injection time, and the obtained value may be taken as the accumulated substance index.

In the analysis device (the pump control section 2) of the vacuum pump according to the present embodiment, the information generation section 252 generates the accumulated substance information based on the integrated value and the time (the gas injection time) in which gas is injected into the vacuum container in the element process Pi for the target object. With this configuration, even if the gas injection time varies according to the element process Pi, a threshold normalized using the gas injection time can be used, and therefore, the information on the substance accumulated on the turbo-molecular pump 100 can be accurately and efficiently provided even in the case of performing various types of vacuuming.

Note that a situation where the accumulated substance is caused also varies according to a gas type, and therefore, various thresholds are preferably set for each gas type.

(Second Variation)

In the above-described embodiment, the accumulated substance information may include information on a load due to a predicted future accumulated substance. The information generation section 252 can derive, e.g., a future accumulated substance amount or future maintenance timing from a previous accumulated substance index change stored in, e.g., the storage section 23.

Figure 5:
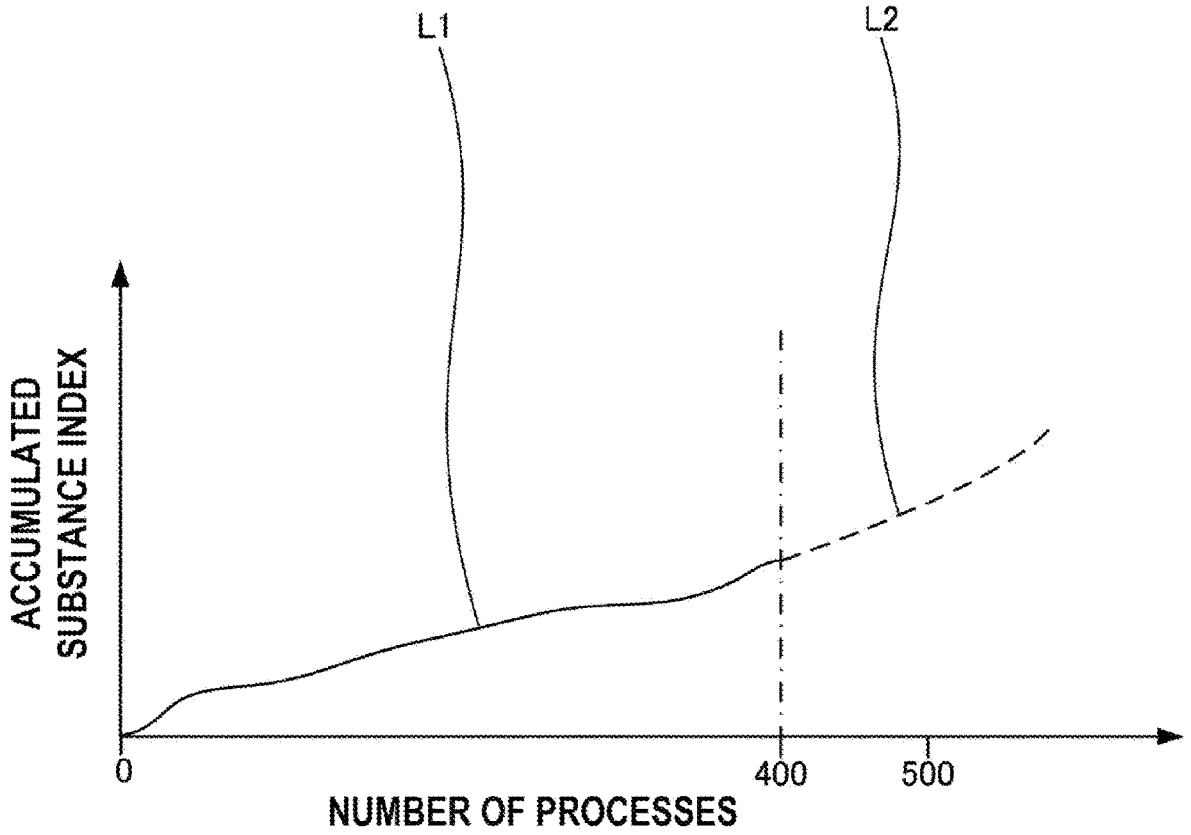
FIG. 5 is a conceptual diagram for describing accumulated substance information of a variation.

FIG. 5 is a conceptual diagram for describing generation of the accumulated substance information of the present variation. A graph of FIG. 5 shows the number of times of execution of the process by the horizontal axis, and shows an accumulated substance index for each process by the vertical axis. In this example, the process has been performed 400 times so far, and the graph shows the previously-calculated accumulated substance index by a solid line L1 when the number of times of execution is smaller than 400 and shows the predicted accumulated substance index by a dashed line L2 when the number of times of execution is greater than 400. As the number of times of execution of the process increases, the accumulated substance index increases according to an increase in the accumulated substance amount. Assuming that the accumulated substance index change is represented by a predetermined mathematical expression, the information generation section 252 calculates and models the coefficient of the mathematical expression from the previously-obtained accumulated substance index to predict a future accumulated substance index change, for example.

(Third Variation)

In the above-described embodiment, the calculation section 251 calculates the integrated value by taking the motor current as the physical quantity regarding the rotary drive. However, the physical quantity regarding the rotary drive is not limited to above, and can be a power value of the motor performing the rotary drive, a pulse width modulation (PWM) control duty ratio, or an amount indicating displacement of the rotor shaft 5 as a shaft of the rotary body unit 45. As in the description above, integrated values of these values can be used as the accumulated substance index, and advantageous effects similar to those of the above-described embodiment can be provided. Displacement of the rotor shaft 5 can be acquired from the displacement sensors arranged at the magnetic bearings 34, 35, 36. As the amount indicating displacement of the pump rotor, a dispersion indicating a variation in displacement may be used.

(Fourth Variation)

In the above-described embodiment, it is configured such that the information generation section 252 arranged at the pump control section 2 generates the accumulated substance information. However, the information generation section 252 can be arranged at an optional computer as long as necessary data is obtained via, e.g., communication. The information generation section 252 may be arranged at the main control section 200, or may be arranged at, e.g., a server, a personal computer, or a mobile terminal at a position physically apart from the main control section 200 and the pump control section 2. Similarly, part of the data used by the vacuum pump system 1000 may be saved in, e.g., a remote server, and at least part of the arithmetic processing performed by the analysis program may be performed by, e.g., a remote server. The processing may be performed by cooperation of two or more processing devices physically apart from each other.

(Fifth Variation)

In the above-described embodiment, the turbo-molecular pump 100 has been described as the magnetic levitation turbo-molecular pump. However, the analysis method of the vacuum pump of the above-described embodiment can be applied to a vacuum pump performing rotary drive and having the probability that a substance is accumulated on a flow path. For example, the analysis method of the above-described embodiment can be also applied to a ball bearing turbo-molecular pump.

(Sixth Variation)

A program for implementing the information processing function of the vacuum pump system 1000 may be recorded in a computer-readable recording medium, and a program, which is recorded in the recording medium, regarding the processing of the above-described information generation section 252 and the processing control associated therewith may be read into a computer system and be executed. Note that the "computer system" described herein includes an operating system (OS) and hardware of peripheral equipment. Moreover, the "computer-readable recording medium" indicates a storage device including a portable recording medium such as a flexible disk, a magnetic optical disk, an optical disk, or a memory card and a hard disk or a solid state drive (SSD) built in the computer system. Further, the "computer-readable recording medium" may include one dynamically holding a program during a short period of time, such as a communication line in a case where a program is transmitted via a network such as the Internet or a line such as a telephone line, and one holding a program for a certain period of time, such as a volatile memory serving as a server or a client in the computer system in the above-described case. The above-described program may be for implementing some of the above-described functions, or may be for implementing the above-described functions in combination with a program already recorded in the computer system.

Figure 6:
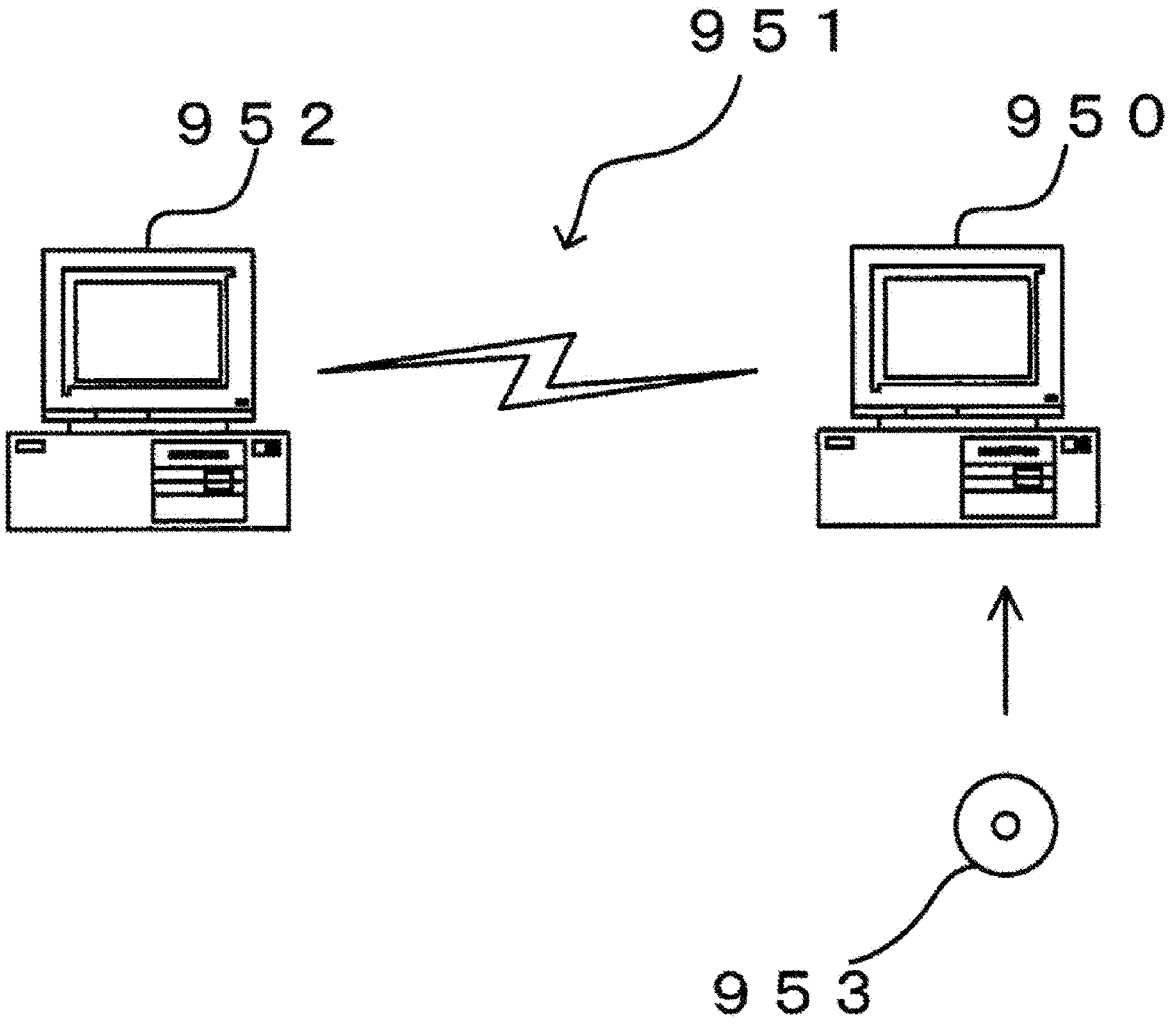
FIG. 6 is a conceptual diagram for describing provision of an analysis program.

In the case of application to, e.g., a personal computer (PC), the program regarding the above-described control can be provided via a recording medium such as a CD-ROM or a DVD-ROM or a data signal on, e.g., the Internet. FIG. 6 is a view showing such a state. A PC 950 receives a program provided via a CD-ROM 953. Moreover, the PC 950 has the function of connection with a communication line 951. A computer 952 is a server computer for providing the above-described program, and stores the program in a recording medium such as a hard disk. The communication line 951 is, e.g., a communication line for the Internet or personal computer communication or a dedicated communication line. The computer 952 reads the program by means of the hard disk, and transmits the program to the PC 950 via the communication line 951. That is, the program is, as a data signal, carried by a carrier wave, and is transmitted via the communication line 951. As described above, the program can be supplied as a computer-readable computer program product in various forms such as a recording medium and a carrier wave.

(Aspects)

Those skilled in the art understand that the above-described multiple exemplary embodiments or the variations thereof are specific examples of the following aspects.

(First Aspect)

An analysis device of a vacuum pump discharging gas from a vacuum container in which a process for a target object is performed, comprises: an information generation section configured to generate information on a load on the vacuum pump due to an accumulated substance based on an integrated value of a physical quantity regarding rotary drive of a rotor of the vacuum pump in at least part of a period of the process.

According to this aspect, the analysis device can accurately and efficiently provide the information on the substance accumulated on the vacuum pump.

(Second Aspect)

The information generation section generates the information based on the integrated value and an injection time in which gas is injected into the vacuum container in the period.

According to this aspect, the analysis device can accurately provide the information on the substance accumulated on the vacuum pump even if the gas injection time varies according to the process.

(Third Aspect)

The information generation section generates the information based on a value obtained by division of the integrated value by the injection time.

According to this aspect, the analysis device can more accurately provide the information on the substance accumulated on the vacuum pump even if the gas injection time varies according to the process.

(Fourth Aspect)

The integrated value is calculated for each target object or every time a particular process is performed for the target object.

According to this aspect, the analysis device can more accurately provide the information on the substance accumulated on the vacuum pump under the same condition.

(Fifth Aspect)

The physical quantity is a current or power value of a motor performing the rotary drive, a PWM control duty ratio, or an amount indicating displacement of a shaft of the rotor.

According to this aspect, the analysis device can provide the information on the substance accumulated on the vacuum pump by means of the characteristics of the above-described values.

(Sixth Aspect)

The vacuum pump is a turbo-molecular pump.

The substance might be accumulated on the flow path in the turbo-molecular pump, and therefore, the above-described aspects can be particularly suitably applied.

(Seventh Aspect)

A vacuum pump comprises: the analysis device of the vacuum pump.

According to this aspect, the analysis device can accurately and efficiently provide the information on the substance accumulated on the vacuum pump.

(Eighth Aspect)

A storage medium recording an analysis program causing a computer to perform analysis processing of a vacuum pump discharging gas from a vacuum container in which a process for a target object is performed. The analysis processing including information generation processing of generating information on a load on the vacuum pump due to an accumulated substance based on an integrated value of a physical quantity regarding rotary drive of a rotor of the vacuum pump in at least part of a period of the process.

According to this aspect, the computer can accurately and efficiently provide the information on the substance accumulated on the vacuum pump.

(Ninth Aspect)

An analysis method of a vacuum pump discharging gas from a vacuum container in which a process for a target object is performed, includes: an information generation step to generate information on a load on the vacuum pump due to an accumulated substance based on an integrated value of a physical quantity regarding rotary drive of a rotor of the vacuum pump in at least part of a period of the process.

(Tenth Aspect)

In the information generation step, the information is generated based on the integrated value and an injection time in which gas is injected into the vacuum container in the period.

(Eleventh Aspect)

In the information generation step, the information is generated based on a value obtained by division of the integrated value by the injection time.

(Twelfth Aspect)

The integrated value is calculated for each target object or every time a particular process is performed for the target object.

(Thirteenth Aspect)

The physical quantity is a current or power value of a motor performing the rotary drive, a PWM control duty ratio, or an amount indicating displacement of a shaft of the rotor.

(Fourteenth Aspect)

The vacuum pump is a turbo-molecular pump.

Various embodiments and the variations have been described above, but the present invention is not limited to the contents of these embodiments and variations. Moreover, each embodiment and variation may be applied alone or in combination. Other aspects conceivable within the scope of the technical idea of the present invention are also included in the scope of the present invention.

What is claimed is:

1. An analysis device of a vacuum pump discharging gas from a vacuum container in which a process for a target object is performed, comprising:

a calculation section configured to calculate an integrated value of a physical quantity regarding rotary drive of a rotor of the vacuum pump for each same process, the physical quantity being a current or power value of a motor performing the rotary drive, a PWM control duty ratio, or an amount indicating displacement of a shaft of the rotor, an information generation section configured to generate information on a load on the vacuum pump due to an accumulated substance based on the integrated value of the physical quantity.

2. The analysis device of the vacuum pump according to claim 1, wherein the information generation section generates the information based on the integrated value and an injection time in which gas is injected into the vacuum container in the period.

3. An analysis device of a vacuum pump discharging gas from a vacuum container in which a process for a target object is performed, comprising:

an information generation section configured to generate information on a load on the vacuum pump due to an accumulated substance based on an integrated value of a physical quantity regarding rotary drive of a rotor of the vacuum pump in at least part of a period of the process, wherein the information generation section generates the information based on the integrated value and an injection time in which gas is injected into the vacuum container in the period, and the information generation section generates the information based on a value obtained by division of the integrated value by the injection time.

4. The analysis device of the vacuum pump according to claim 1, wherein the integrated value is calculated for each target object or every time a particular process is performed for the target object.

5. The analysis device of the vacuum pump according to claim 1, wherein the vacuum pump is a turbo-molecular pump.

6. A vacuum pump comprising:

the analysis device of the vacuum pump according to claim 1.

7. A storage medium recording an analysis program causing a computer to perform analysis processing of a vacuum pump discharging gas from a vacuum container in which a process for a target object is performed, the analysis processing including a calculation processing of calculating an integrated value of a physical quantity regarding rotary drive of a rotor of the vacuum pump for each same process, the physical quantity being a current or power value of a motor performing the rotary drive, a PWM control duty ratio, or an amount indicating displacement of a shaft of the rotor, and information generation processing of generating information on a load on the vacuum pump due to an accumulated substance based on the integrated value of the physical quantity.

8. An analysis method of a vacuum pump discharging gas from a vacuum container in which a process for a target object is performed, including:

a calculation step of calculating an integrated value of a physical quantity regarding rotary drive of a rotor of the vacuum pump for each same process, the physical quantity being a current or power value of a motor performing the rotary drive, a PWM control duty ratio, or an amount indicating displacement of a shaft of the rotor, and an information generation step to generate information on a load on the vacuum pump due to an accumulated substance based on the integrated value of the physical quantity.

9. The analysis method of the vacuum pump according to claim 8, wherein in the information generation step, the information is generated based on the integrated value and an injection time in which gas is injected into the vacuum container in the period.

10. An analysis method of a vacuum pump discharging gas from a vacuum container in which a process for a target object is performed, including:

an information generation step to generate information on a load on the vacuum pump due to an accumulated substance based on an integrated value of a physical quantity regarding rotary drive of a rotor of the vacuum pump in at least part of a period of the process, wherein in the information generation step, the information is generated based on the integrated value and an injection time in which gas is injected into the vacuum container in the period, and in the information generation step, the information is generated based on a value obtained by division of the integrated value by the injection time.

11. The analysis method of the vacuum pump according to claim 8, wherein the integrated value is calculated for each target object or every time a particular process is performed for the target object.

12. The analysis method of the vacuum pump according to claim 8, wherein the vacuum pump is a turbo-molecular pump.

* * * * *